US006244225B1

(12) United States Patent
Takahashi et al.

(10) Patent No.: US 6,244,225 B1
(45) Date of Patent: Jun. 12, 2001

(54) COOLING STRUCTURE OF MULTI-CYLINDER ENGINE

(75) Inventors: Katsunori Takahashi; Hiroatsu Inui; Tetsuya Nakanishi, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,738

(22) Filed: Sep. 14, 1999

(30) Foreign Application Priority Data

Sep. 14, 1998 (JP) ..... 10-279423

(51) Int. Cl.[7] ..... F01F 1/36
(52) U.S. Cl. ..... 123/41.82 R
(58) Field of Search ..... 123/41.82 R, 41.79, 123/41.82 A, 41.28, 41.29

(56) References Cited

U.S. PATENT DOCUMENTS 4,346,676 * 8/1982 Tyner ..... 123/41.74

FOREIGN PATENT DOCUMENTS 2121161 6/1989 (JP) .

* cited by examiner

*Primary Examiner*—Willis R. Wolfe
*Assistant Examiner*—Katrina B. Harris
(74) *Attorney, Agent, or Firm*—Birch, Stewart, Kolasch & Birch, LLP

(57) ABSTRACT

A bulkhead is integrally provided in the water jacket provided within the cylinder head of an in-line type four-cylinder engine in the array direction of each cylinder, a cooling water outlet section is provided on the central section in the longitudinal direction of this water outlet side passage, and an outlet to the main body of the water jacket is provided near the bulkhead opposite to that.

20 Claims, 3 Drawing Sheets

COOLING STRUCTURE OF MULTI-CYLINDER ENGINE

BACKGROUND OF THE INVENTION

1. Field of the Invention

The present invention relates to the advantageous structure of a cooling water passage in a water-cooled in-line type multi-cylinder engine.

2. Description of the Background Art

A cooling structure of a water-cooled in-line type two-cylinder engine is described in Japanese Utility model publication Hei 1-21161. In this example, a collecting passage for the cooling water is provided between both cylinders integrally with the cylinder head, and a thermostat is attached on the outlet of this collective passage.

Moreover, some in-line type multi-cylinder engines such as a four-cylinder engine may have a structure in which both ends of the water outlet side passage provided on another body separate from the cylinder head are communicated to the cylinder side water passage on both ends and joined together on the thermostat section provided on the center section.

Since the piping sections leading to the thermostat will increase if the water outlet side passage is provided outside the cylinder head, it would be preferable to form the water outlet side passage integrally with the cylinder head as shown in the conventional example. However, if this structure is applied to the in-line type four-cylinder engine, the water outlet side passages between cylinders converge on the thermostat section so that the flow of the cooling water is bound to be nonuniform. There is thus a desire to solve this problem in order to improve the cooling performance.

SUMMARY OF THE INVENTION

This invention has a main object to solve such problem. A cooling water outlet for the water jacket which is provided centrally in the array direction of each cylinder on a cylinder head of a multi-cylinder engine. A bulkhead is provided within the water jacket, extending in the array direction of each cylinder to divide the inside into an outlet side and a main body section, so that the cooling water that cooled each cylinder, by flowing along the bulkhead, is collected in one place within the cylinder head on the opposite side of the bulkhead and flows to the cooling water outlet, thereby further simplifying the external water piping.

The bulkhead is formed integrally with the cylinder head so that manufacturing performance is improved since the bulkhead is formed simultaneously when the cylinder head is formed. A case for the thermostat is attached directly on the cooling water outlet, thereby further simplifying the external piping.

The bulkhead extends to a position near the center of a cylinder outside the outlet side and the main body section so that the cooling water is guided to both sides, and then flows to the cooling water outlet side, eliminating stagnation of the cooling water with improved cooling performance.

The cooling water inlet to the cylinder head is formed on the opposite side to the cooling water outlet side and centrally in the array direction of each cylinder. The cooling water inlet to the cylinder head converges at the central section of the opposite side so that the cooling water is uniformly distributed to each cylinder by being guided by the bulkhead, thereby making it possible to uniformly cool each cylinder.

An open hole for venting air is formed on the bulkhead so that the air staying in the water jacket is rapidly discharged to the cooling water outlet side.

A cooling water inlet for the water to flow from the water pump to the water jacket of the cylinder is provided on the same side as the cooling water outlet side. The cooling water inlet to the cylinder is provided in the direction to the central side cylinder of the same side as the cooling water outlet so that the cooling water inlets are concentrated on one side of the engine, thereby making the piping easier.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
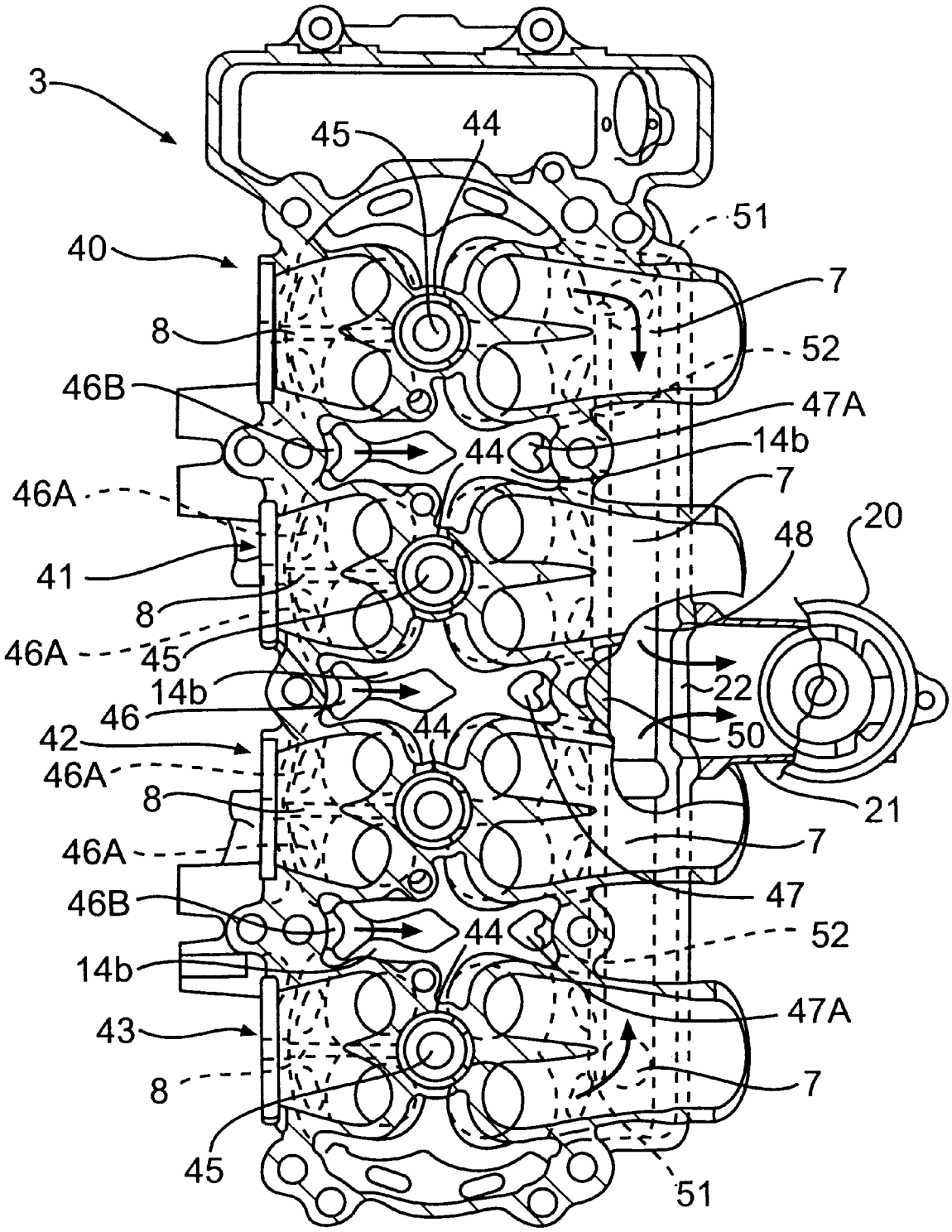
FIG. 1 is a cross-sectional view taken along line 1—1 in FIG. 3.
Figure 2:
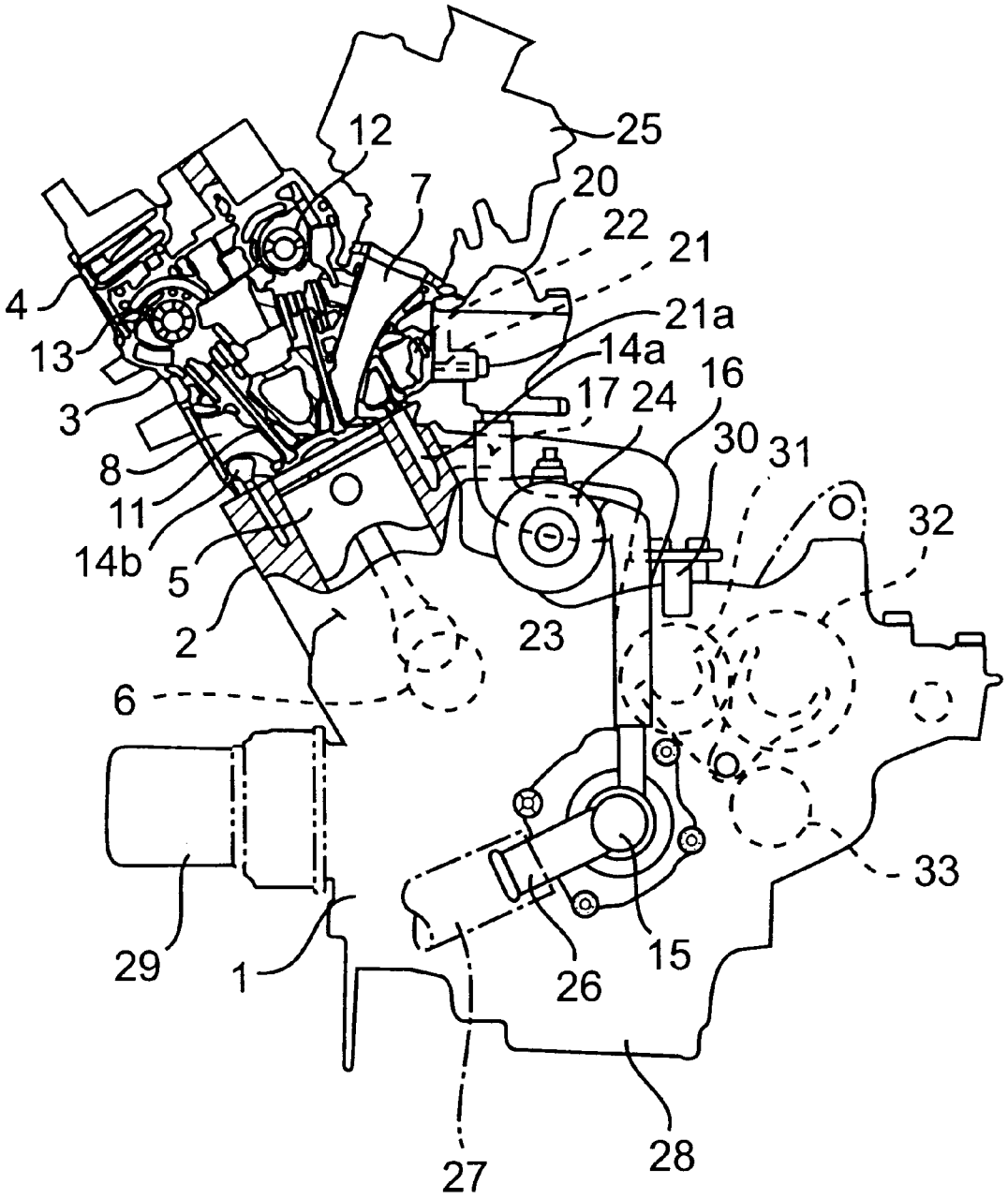
FIG. 2 is a side view of the engine partially cut-away.

First, the brief structure of the engine is described hereafter using FIGS. 1 and 2. This engine is a dual overhead camshaft (DOHC) type water-cooled four-cycle engine with a crankcase 1, a cylinder 2, a cylinder head 3, and a cylinder head cover 4.

A piston 5 is contained in the cylinder 2 and is freely slidable therein. The piston 5 is connected with a crankshaft 6 (the center part is not shown). A combustion chamber is formed between the piston 5 and the cylinder 2, as well as the cylinder head 3.

An air inlet port 7 and an exhaust port 8 communicating with this combustion chamber are provided on the cylinder head 3 and respectively opened or closed by an air inlet valve 10 and an exhaust valve 11. The air inlet valve 10 and exhaust valve 11 are driven by cams on camshafts 12, 13 that rotate synchronously with the crankshaft 6.

A water jacket 14*a* is provided In the cylinder 2, and a water jacket 14*b* is provided in the cylinder head 3. Cooling water is supplied from a joint pipe 17 provided on the back face of the cylinder 2 to the inlet of the water jacket 14*a* through a hose 16, driven by a water pump 15 provided on the crankcase 1.

The cooling water heated in the water jacket 14*a*, 14*b* is transferred to a radiator arranged on the forward part of the engine through a thermostat 20 containing a thermostat valve attached on the back face of the cylinder head 3, and cooled again here to be circulated to the water pump 15. The thermostat 20 is directly attached to a cooling water outlet section 22 on the water jacket 14*b* positioned on the back face of the cylinder head 3 near the air inlet port 7 by means of a uniform joint 21 with a bolt 21*a* so that the cooling water flows directly from the outlet section 22 into the thermostat 20 without passing through a water hose.

Moreover, the thermostat valve is a bottom bypass type thermostat valve provided with a bypass circuit having a bypass hose 23 connecting with the water pump 15 so that, if the temperature of the water is less than a specified temperature value, the thermostat valve is switched to the bypass circuit so as not to feed the cooling water heated by the engine to the radiator but to directly return the water from the bypass hose 23 to the water pump 15.

A starter motor 24 is provided at an under side of the thermostat 20 near the back face of the cylinder 2 and on the upper face of the crankcase 1. Moreover, a carburetor 25 is arranged within the rear space of the back face of the cylinder head 3 near an upper position of the thermostat 20. Reference numeral 26 in the drawings indicates the suction pipe with which the cooling water from the radiator is supplied through the water hose 27, reference numeral 28 indicates an oil pan, reference numeral 29 indicates an oil filter, and reference numeral 30 indicates a speed sensor for the transmission provided on the main shaft 31 of the transmission. Reference numeral 32 indicates a counter shaft, and reference numeral 33 indicates a shift drum.

As shown in FIG. 1, four cylinders 40, 41, 42, and 43 are provided transversally in the same cylinder head, and among them, two cylinders 40 and 43 are outside cylinders, and two cylinders 41 and 42 sandwiched between them are inside cylinders in this patent specification. The air inlet port 7 and the exhaust port 8, as well as a plug hole 45 formed at the center of the ceiling section 44 of the combustion chamber, are provided as a cylinder head structure for those cylinders.

The water jacket 14*b* on the cylinder head side is formed between a ceiling section 44 of the combustion chamber for each cylinder. A cooling water inlet 46 from the water jacket 14*a* on the cylinder side to the water jacket 14*b* on the cylinder head side is formed between each exhaust port 8 for inside cylinder 41, 42 in front of the cylinder head 3, and a water hole 46A is formed at two positions on each of the right and left side on the lower side of each exhaust port 8 on this cooling water inlet 46.

An outlet 47 is provided between the air inlet port 7 at a rear section of the cylinder head 3 and communicates with a water outlet side passage 48. A hole 46B, 47A is formed between the outside cylinders 40, 43 and the inside cylinders 41, 42, but they are preferably closed. It should be understood that these holes 46B, 47A may be opened to vary the flow characteristics of the cooling water through the cylinder head 3. However, in this example, the cooling water only flows from the water jacket 14*a* on the cylinder side through the cooling water inlet 46 provided centrally in the transverse direction and the water holes 46A being provided two each on the left and right of the cooling water inlet 46. Similarly, the cooling water flows out only from the outlet 47 provided centrally in the transverse direction to the passage 48 on the water outlet side.

Figure 3:
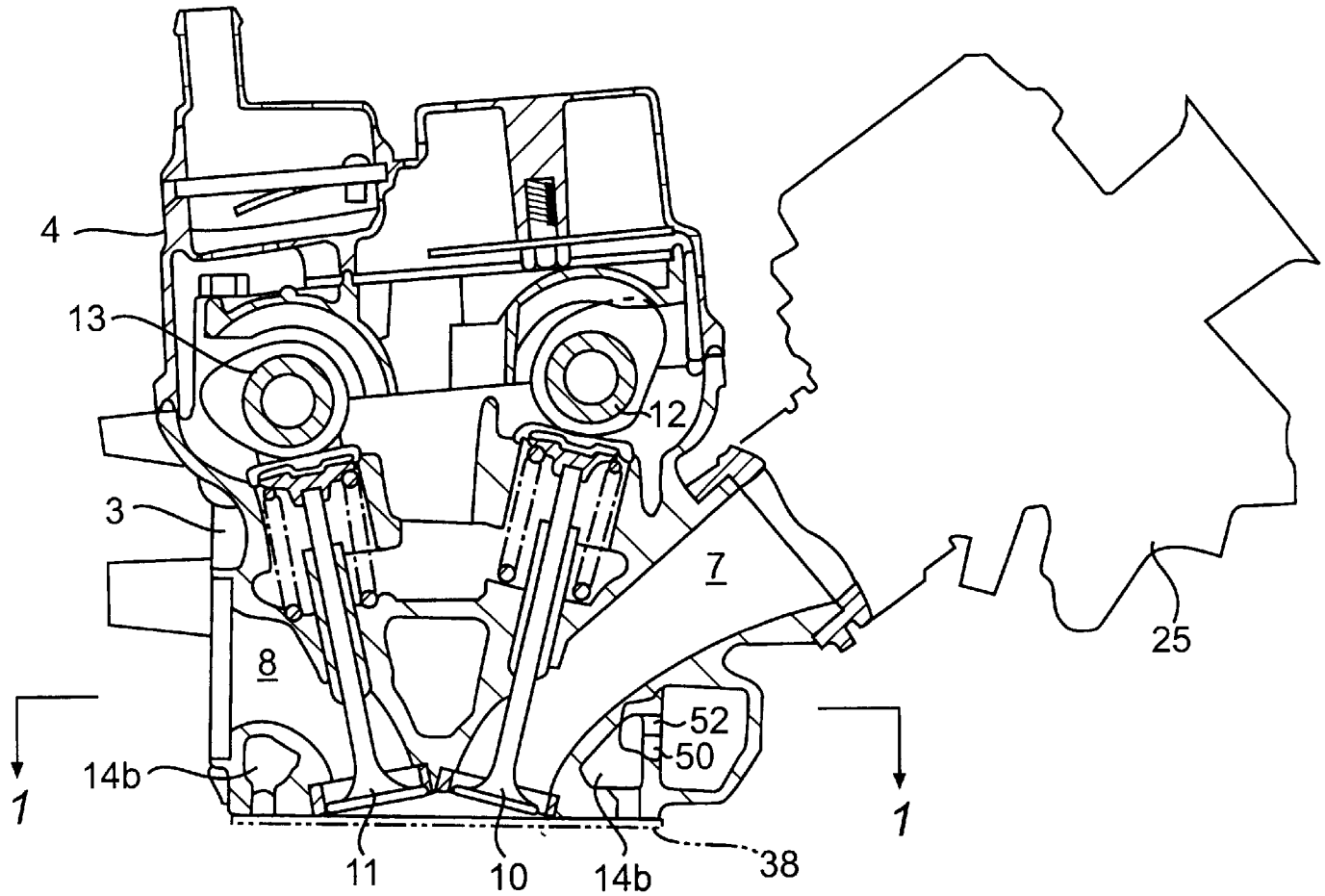
FIG. 3 is a cross-sectional view of the main part of the engine.

The flow of cooling water is controlled with a head gasket 38 (FIG. 3) mounted between the cylinder head 3 and the cylinder 2. Thus, it is possible to arbitrarily stop or decrease the flow of cooling water for the cooling water inlet 46 on both sides by means of an arrangement of a hole to be provided on the head gasket 38.

In this example, the cooling water flows from the water jacket 14*a* side only to the cooling water inlet 46 at the center positions. This cooling water inlet 46 is located at the same position as the cooling water outlet section 22 in the array direction of each cylinder, and the cooling water outlet section 22 is located at the opposite position in the longitudinal direction. Therefore, the cooling water flows from the water hole 46A and cooling water inlet 46 into the water jacket 14*b*, the partial cooling water emerges from the cooling water inlet 46 to the upper side of the exhaust port 8 and proceeds to the cooling water outlet section 22 side while flowing around the plug hole 45, and then flows from the outlet 47 at the center into the under side of the air inlet port 7 of the water jacket.

The water outlet side passage 48 extends inside the rear section of the cylinder head 3 in the array direction of each cylinder, namely, in the transverse direction (direction of an axle) parallel to the center line direction of the crankshaft, being formed as one piece in this example. The cooling water outlet section 22 is formed at the center, communicating with a joint 21 of the thermostat 20. A cooling water inlet from the water pump 15 is provided at a position under and near the cooling water outlet 22, being connected with one end of the water hose 16.

A bulkhead 50 is formed on the water outlet side passage 48 extending in the longitudinal direction within the water outlet side passage 48, and its two end sections 51 extend to the outside further than each central section of the outside cylinder 40, 43, dividing the water jacket 14*b* into a section on the cooling water outlet section 22 side and a water jacket main body section. The cooling water flowing from the outlet 47 into the water outlet side passage 48 directly converges at the outlet section 22 by means of this bulkhead 50. An air venting hole 52 is formed as a fine piercing hole on one part of the bulkhead 50.

The effects of this example are described hereafter. The bulkhead 50 that extends in the direction of the array of each cylinder 40, 41, 42, 43 and divides the water outlet side passage 48 on the cooling water outlet side is provided in the water jacket 14*b*. The cooling water outlet section 22 is provided on the central section in the longitudinal direction of the water outlet passage extending in the array direction of each cylinder. The water outlet section 22 is provided on the outside of the bulkhead 50 so that the cooling water having cooled each cylinder converges at one position in the water outlet side passage 48. The cooling water flows along the bulkhead 50 within the water jacket main section and flows to the cooling water outlet section 22, thereby further simplifying the external water piping.

The bulkhead 50 is formed integrally with the cylinder head 3 so that the bulkhead is formed at the same time as the cylinder head, with improved manufacturing performance. It is also possible to form this bulkhead 50 as another part separately from the cylinder head 3. The thermostat 20 is directly attached on the cooling water outlet 22, thereby further simplifying the external piping.

The bulkhead 50 extends the position near the center of both outside cylinders 40, 43 so that the cooling water is guided to both sides of the bulkhead 50, then enters the water outlet side passage 48, and proceeds to the cooling water outlet side without stagnation of the cooling water, thus improving cooling performance. In addition, the cooling water inlet 46 to the cylinder head 3 is collectively formed at the center section opposite to the cooling water outlet 22 side so that the cooling water flows from the cooling water inlet 46 to the outlet 47 on the opposite side through the central section of the cylinder head 3 and enters the main section of the water jacket 14*b*, and is then uniformly distributed to each cylinder while being guided by the bulkhead 50, thereby making it possible to uniformly cool each cylinder.

The air venting hole 52 is formed on the bulkhead 50 so that any air stagnated in the water jacket 14*b* will be rapidly discharged to the outlet side, thereby making it possible to prevent the flow of the cooling water from being stagnated by air stagnation. Further, the cooling water inlet is provided in the direction from the water pump 15 to the center cylinders 41, 42 on the same side as the cooling water outlet 22 side so that the inlet and outlet for the cooling water are concentrated to one side of the engine, thereby making the piping work easier.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cooling structure for a multi-cylinder engine comprising:

a cooling water outlet for a water jacket provided substantially centrally in an array direction of each cylinder in a cylinder head of the multi-cylinder engine; and a bulkhead provided within said water jacket, extending in the array direction of each cylinder to divide an inside of the cooling water outlet into an outlet side and a main body section.

2. The cooling structure for a multi-cylinder engine as set forth in claim 1, wherein said bulkhead is formed integrally with the cylinder head.

3. The cooling structure for a multi-cylinder engine as set forth in claim 1, wherein a case for a thermostat valve is attached on said cooling water outlet.

4. The cooling structure for a multi-cylinder engine as set forth in claim 1, wherein said bulkhead extends to a position near a center of a cylinder outside of the outlet side and the main body section.

5. The cooling structure for a multi-cylinder engine as set forth in claim 1, wherein a cooling water inlet to the cylinder head is formed on a side opposite to said cooling water outlet and substantially centrally in the array direction of each cylinder.

6. The cooling structure for a multi-cylinder engine as set forth in claim 1, wherein an opening hole for venting air is formed in said bulkhead.

7. The cooling structure for a multi-cylinder engine as set forth in claim 1, wherein a cooling water inlet for water to flow from a water pump into a water jacket of a cylinder block of said engine is provided on a same side as said cooling water outlet.

8. The cooling structure according to claim 1, wherein said cylinder head includes four cylinder combustion chambers aligned in a row, and said bulkhead is substantially straight and parallel to said row of combustion chambers and extends for a length greater than a distance between centers of two outermost ones of said combustion chambers.

9. A cooling structure for an engine having a plurality of cylinders arranged in a longitudinal direction, said cooling structure comprising:

a cylinder head having a cylinder head water jacket formed therein;

a longitudinally-extending water chamber formed within said cylinder head and communicating with said cylinder head water jacket;

a longitudinally-extending bulkhead located within said longitudinally-extending water chamber, said longitudinally-extending bulkhead dividing said longitudinally-extending water chamber into a water jacket chamber portion and an outlet chamber portion; and a water discharge opening located in a sidewall of said cylinder head and in communication with said outlet chamber portion of said longitudinally-extending water chamber.

10. The cooling structure according to claim 9, wherein said cylinder head is a casting, and said bulkhead is cast integrally therewith as a one-piece unitary member.

11. The cooling structure according to claim 9, further comprising a thermostat case connected to said sidewall of said cylinder head at said water discharge opening.

12. The cooling structure according to claim 9, wherein said cylinder head includes at least one water inlet opening in communication with said cylinder head water jacket, said water inlet opening being located on a side opposite to said water discharge opening.

13. The cooling structure according to claim 12, wherein said at least one water inlet opening is located approximately centrally along said longitudinal direction.

14. The cooling structure according to claim 9, wherein said water discharge opening is located approximately centrally along said longitudinal direction.

15. The cooling structure according to claim 9, wherein said bulkhead includes at least one vent hole formed therein.

16. The cooling structure according to claim 9, further comprising:

a cylinder block having a cylinder block water jacket formed therein, said cylinder block water jacket being in communication with said cylinder head water jacket; and a water supply opening located in a sidewall of said cylinder block and in communication with said cylinder block water jacket.

17. The cooling structure according to claim 16, wherein said water supply opening and said water outlet opening are located on a same side of said engine.

18. The cooling structure according to claim 16, further comprising a water pump attached to said cylinder block and in communication with said cylinder block water jacket.

19. The cooling structure according to claim 9, wherein said cylinder head includes four cylinder combustion chambers aligned in a row, and said longitudinally-extending bulkhead extends for a length greater than a distance between centers of two outermost ones of said combustion chambers.

20. The cooling structure according to claim 19, wherein said longitudinally-extending bulkhead is substantially straight and parallel to said row of combustion chambers.

* * * * *